US011148777B2

(12) United States Patent
Masuda

(10) Patent No.: US 11,148,777 B2
(45) Date of Patent: Oct. 19, 2021

(54) OUTBOARD MOTOR

(71) Applicant: YAMAHA HATSUDOKI KABUSHIKI KAISHA, Iwata (JP)

(72) Inventor: Chiharu Masuda, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 62 days.

(21) Appl. No.: 16/375,869

(22) Filed: Apr. 5, 2019

(65) Prior Publication Data

US 2019/0322343 A1 Oct. 24, 2019

(30) Foreign Application Priority Data

Apr. 19, 2018 (JP) ..... JP2018-080551

(51) Int. Cl.
*B63H 20/32* (2006.01)
*B63H 20/14* (2006.01)
*F02B 61/04* (2006.01)

(52) U.S. Cl.
CPC ..... *B63H 20/32* (2013.01); *B63H 20/14* (2013.01); *F02B 61/045* (2013.01)

(58) Field of Classification Search
CPC .. B63H 20/14; B63H 20/32; B63H 2020/323; B63H 2020/326; B63H 21/28; F02B 61/045; F16F 15/1207; F16F 15/1208; F16F 15/1209
See application file for complete search history.

(56) References Cited

U.S. PATENT DOCUMENTS 2,945,138 A * 7/1960 Strang ..... H02K 1/2786 310/153
5,074,812 A 12/1991 Watanabe
5,078,101 A * 1/1992 Anderson ..... F01P 1/06 123/149 D
5,778,847 A * 7/1998 Takahashi ..... F01M 1/02 123/195 P
5,876,188 A * 3/1999 Okamoto ..... F01M 1/02 184/6.18
6,213,826 B1 * 4/2001 Koishikawa ..... F01M 11/02 123/195 P
6,527,604 B2 * 3/2003 Tsubouchi ..... F01M 1/02 440/88 L
6,652,334 B1 * 11/2003 Kusche ..... F02B 61/045 440/52
6,796,860 B1 * 9/2004 Takahashi ..... B63H 20/002 123/196 W
7,073,474 B2 * 7/2006 Biel ..... F02B 75/06 123/192.1

FOREIGN PATENT DOCUMENTS

JP 2711706 B2 2/1998
JP 2001-303920 A 10/2001

* cited by examiner

*Primary Examiner* — Ajay Vasudeva
(74) *Attorney, Agent, or Firm* — Keating & Bennett, LLP

(57) ABSTRACT

An outboard motor includes an engine, a crankshaft, a crankcase, a support that contacts a lower end of the crankcase, and a damper connected to a lower portion of the crankshaft and disposed in an isolated space defined by the crankcase and the support.

19 Claims, 7 Drawing Sheets

OUTBOARD MOTOR

CROSS REFERENCE TO RELATED APPLICATIONS

This application claims the benefit of priority to Japanese Patent Application No. 2018-080551 filed on Apr. 19, 2018. The entire contents of this application are hereby incorporated herein by reference.

BACKGROUND OF THE INVENTION

1. Field of the Invention

The present invention relates to an outboard motor.

2. Description of the Related Art

An outboard motor including a crankshaft that extends downward from an engine is known in general. Such an outboard motor is disclosed in Japanese Patent No. 2711706, for example.

Japanese Patent No. 2711706 discloses a marine propulsion unit (outboard motor) including a crankshaft that extends downward from an engine and a torsional damper attached to a lower portion of the crankshaft and that attenuates torsional vibrations of the crankshaft. The torsional damper of the marine propulsion unit includes a mount attached to the crankshaft, a mass member, and a rubber member disposed between the mount and the mass member. Furthermore, the torsional damper of the marine propulsion unit includes a catch that catches leaking oil and a discharge path through which the leaking oil is discharged to a portion below the mount in order to prevent an increase in replacement (maintenance) frequency due to changes in the characteristics of the rubber member caused by contact of the oil that leaks from the engine with the rubber member.

However, in the marine propulsion unit disclosed in Japanese Patent No. 2711706, oil scattered from the engine, for example, is not sufficiently caught by the catch, and the oil is not conceivably prevented from reaching the rubber member of the torsional damper. Consequently, there is a disadvantage that the changes in the characteristics of the rubber member (damper) of the torsional damper may not be sufficiently reduced or prevented. In other words, there is a problem that external foreign matter may not be prevented from reaching a functional component such as the damper connected to the lower portion of the crankshaft.

SUMMARY OF THE INVENTION

Preferred embodiments of the present invention provide outboard motors in which external foreign matter is prevented from reaching functional components connected to lower portions of crankshafts.

An outboard motor according to a preferred embodiment of the present invention includes an engine, a crankshaft that extends downward from the engine, a crankcase that houses the crankshaft, a support that contacts a lower end of the crankcase, and a damper connected to a lower portion of the crankshaft and disposed in an isolated space defined by the crankcase and the support. The term "isolated space" indicates a broader concept including not only a space completely isolated from other spaces but also a space not completely isolated from other spaces but in which communication with other spaces is restricted.

In an outboard motor according to a preferred embodiment of the present invention, the damper (functional component) is disposed in the isolated space defined by the crankcase and the support such that even when foreign matter (such as oil and water) is splashed from external spaces in which the engine and other elements are disposed, the foreign matter is prevented from entering the isolated space, and thus the foreign matter is prevented from reaching the damper. That is, the isolated space prevents the foreign matter (such as oil and water) from the outside from reaching the damper as a functional component connected to the lower portion of the crankshaft. Consequently, changes in the characteristics of the damper due to the foreign matter are sufficiently significantly reduced or prevented.

In an outboard motor according to a preferred embodiment of the present invention, an oil space through which oil flows is preferably provided inside the crankcase, the oil space and a water space through which water flows are preferably provided below the crankcase, and the isolated space is preferably isolated from the oil space and the water space. The term "oil space through which oil flows" is not restricted to a flow path through which oil flows, but indicates a space in which oil is usually present, such as a space into which a small amount of oil that leaks from the engine moves. Similarly, the term "water space through which water flows" is not restricted to a flow path through which water flows, but indicates a space in which water is usually present. Accordingly, even when the oil space and the water space are located around the isolated space defined by the crankcase and the support, the isolated space is isolated from the oil space and the water space, and thus oil and water are prevented from entering the isolated space. Consequently, the oil and the water as foreign matter from the outside are prevented from reaching the damper.

In such a case, the isolated space is preferably substantially sealed such that the isolated space is isolated from the oil space and the water space. Accordingly, foreign matter such as oil and water from the outside is more effectively prevented from entering the isolated space.

An outboard motor in which the isolated space is substantially sealed preferably further includes a cowling that covers the engine, and the crankcase preferably includes a communication hole that opens into the substantially sealed isolated space and the cowling. Accordingly, air in the isolated space is discharged into the cowling via the communication hole. The inside of the cowling includes less foreign matter (oil and water) than the oil space and the water space, and thus ventilation in the isolated space is performed via the communication hole while the oil and the water are prevented from moving into the isolated space. Thus, the air, the temperature of which has been increased in the isolated space, is discharged into the cowling, for example, such that an increase in temperature in the isolated space is significantly reduced or prevented.

In an outboard motor in which the crankcase includes the communication hole, the communication hole is preferably inclined downward from the isolated space into the cowling. Accordingly, even when water vapor slightly contained in air in the cowling is liquefied in the communication hole, due to the downward inclination of the communication hole into the cowling, liquefied water (foreign matter) is prevented from running down toward the isolated space. Consequently, the water as foreign matter is prevented from entering the isolated space via the communication hole.

In an outboard motor in which the oil space is provided inside the crankcase, the lower end of the crankcase and an upper end of the support preferably contact each other to define the isolated space and the oil space. Accordingly, the isolated space is easily defined by the crankcase and the support, and the oil space is easily provided inside and below the crankcase.

In an outboard motor in which the oil space and the water space are provided below the crankcase, the isolated space is preferably disposed directly above the water space in the support. Accordingly, as compared with the case in which the isolated space is not disposed directly above the water space (is disposed adjacent to the water space in a horizontal direction, for example), the area of the isolated space is increased in a plane perpendicular to a vertical direction.

In an outboard motor according to a preferred embodiment of the present invention, a case-side recess recessed upward is preferably provided in a lower portion of the crankcase, and a support-side recess recessed downward and that defines the isolated space together with the case-side recess is preferably provided in an upper portion of the support. Accordingly, the isolated space having a certain volume is reliably provided due to the two recesses (the case-side recess and the support-side recess), and thus the damper is reliably disposed in the isolated space.

In such a case, the damper is preferably disposed in the case-side recess of the isolated space. Accordingly, the damper is disposed on the crankcase side in an upper portion of the isolated space, and thus as compared with the case in which the damper is disposed in the support-side recess of the isolated space, the length of the crankshaft to which the damper is attached is reduced in the vertical direction. Consequently, an increase in the size of the outboard motor in the vertical direction is significantly reduced or prevented.

An outboard motor according to a preferred embodiment of the present invention preferably further includes a first seal that surrounds at least the isolated space and seals the lower end of the crankcase to an upper end of the support. Accordingly, the first seal prevents foreign matter from entering the isolated space from between the lower end of the crankcase and the upper end of the support.

In such a case, the lower end of the crankcase and the upper end of the support preferably contact each other to define the isolated space and an oil space through which oil flows, and the first seal preferably surrounds the oil space in addition to the isolated space. Accordingly, leakage of the oil from the oil space is significantly reduced or prevented while the first seal prevents foreign matter including the oil from entering the isolated space from between the lower end of the crankcase and the upper end of the support.

In an outboard motor according to a preferred embodiment of the present invention, the crankshaft preferably extends downward in the isolated space through a first through-hole that passes through the crankcase in a vertical direction, and the outboard motor preferably further includes a second seal that seals the first through-hole of the crankcase to the crankshaft. Accordingly, the second seal prevents foreign matter from entering the isolated space via the first through-hole.

An outboard motor according to a preferred embodiment of the present invention preferably further includes a drive shaft connected to the lower portion of the crankshaft in the isolated space and that extends downward through a second through-hole that passes through the support in a vertical direction, and a third seal that seals the second through-hole of the support to the drive shaft. Accordingly, the third seal prevents foreign matter from entering the isolated space via the second through-hole.

In an outboard motor according to a preferred embodiment of the present invention, an oil space through which oil flows is preferably provided inside the crankcase, the outboard motor preferably further includes an oil pump disposed in the oil space inside the crankcase and that circulates the oil in the oil space, and a gear attached to the crankshaft and that transmits a rotational drive force of the crankshaft to the oil pump, and the isolated space is preferably disposed below the gear. Accordingly, the damper connected to the lower portion of the crankshaft is reliably disposed in the isolated space while the oil pump is driven by the crankshaft and the gear.

An outboard motor in which the oil space and the water space are provided below the crankcase preferably further includes a drive shaft connected to a lower end of the crankshaft in the isolated space and that extends downward through a second through-hole of the support, and an upper case that houses the drive shaft, and the support is preferably an exhaust guide disposed between the crankcase and the upper case and in which a portion of the isolated space, the oil space, the water space, and an exhaust space through which exhaust gas from the engine flows are provided. Accordingly, the isolated space, in which the damper as a component member connected to the lower portion of the crankshaft is disposed, is defined by the exhaust guide disposed between the crankcase and the upper case together with the crankcase.

An outboard motor according to a preferred embodiment of the present invention includes an engine, a crankshaft that extends downward from the engine, a crankcase that houses the crankshaft, a support that contacts a lower end of the crankcase, and a functional component connected to a lower portion of the crankshaft and disposed in an isolated space defined by the crankcase and the support.

In an outboard motor according to a preferred embodiment of the present invention, the isolated space prevents foreign matter from the outside from reaching the functional component connected to the lower portion of the crankshaft.

In an outboard motor according to a preferred embodiment of the present invention, an oil space through which oil flows is preferably provided inside the crankcase, the oil space and a water space through which water flows are preferably provided below the crankcase, and the isolated space is preferably isolated from the oil space and the water space. Accordingly, the oil and the water as foreign matter from the outside are prevented from reaching the functional component.

In such a case, the isolated space is preferably substantially sealed such that the isolated space is isolated from the oil space and the water space. Accordingly, foreign matter from the outside is more effectively prevented from entering the isolated space.

An outboard motor in which the isolated space is substantially sealed preferably further includes a cowling that covers the engine, and the crankcase preferably includes a communication hole that opens into the substantially sealed isolated space and the cowling. Accordingly, ventilation in the isolated space is performed via the communication hole while foreign matter is prevented from moving into the isolated space.

In an outboard motor according to a preferred embodiment of the present invention, a case-side recess recessed upward is preferably provided in a lower portion of the crankcase, and a support-side recess recessed downward and that defines the isolated space together with the case-side recess is preferably provided in an upper portion of the support. Accordingly, the isolated space having a certain volume is reliably provided due to the two recesses (the case-side recess and the support-side recess), and thus the functional component is reliably disposed in the isolated space.

An outboard motor according to a preferred embodiment of the present invention includes an engine, a crankshaft that extends downward from the engine, a crankcase that houses the crankshaft, a support that contacts a lower end of the crankcase, and an isolated space defined by the crankcase and the support.

In an outboard motor according to a preferred embodiment of the present invention, when a component connected to a lower portion of the crankshaft is disposed in the isolated space, the isolated space prevents foreign matter from the outside from reaching the component connected to the lower portion of the crankshaft.

The above and other elements, features, steps, characteristics and advantages of preferred embodiments of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of an outboard motor 100 according to a first preferred embodiment of the present invention is now described with reference to FIGS. 1 to 9.

Figure 1:
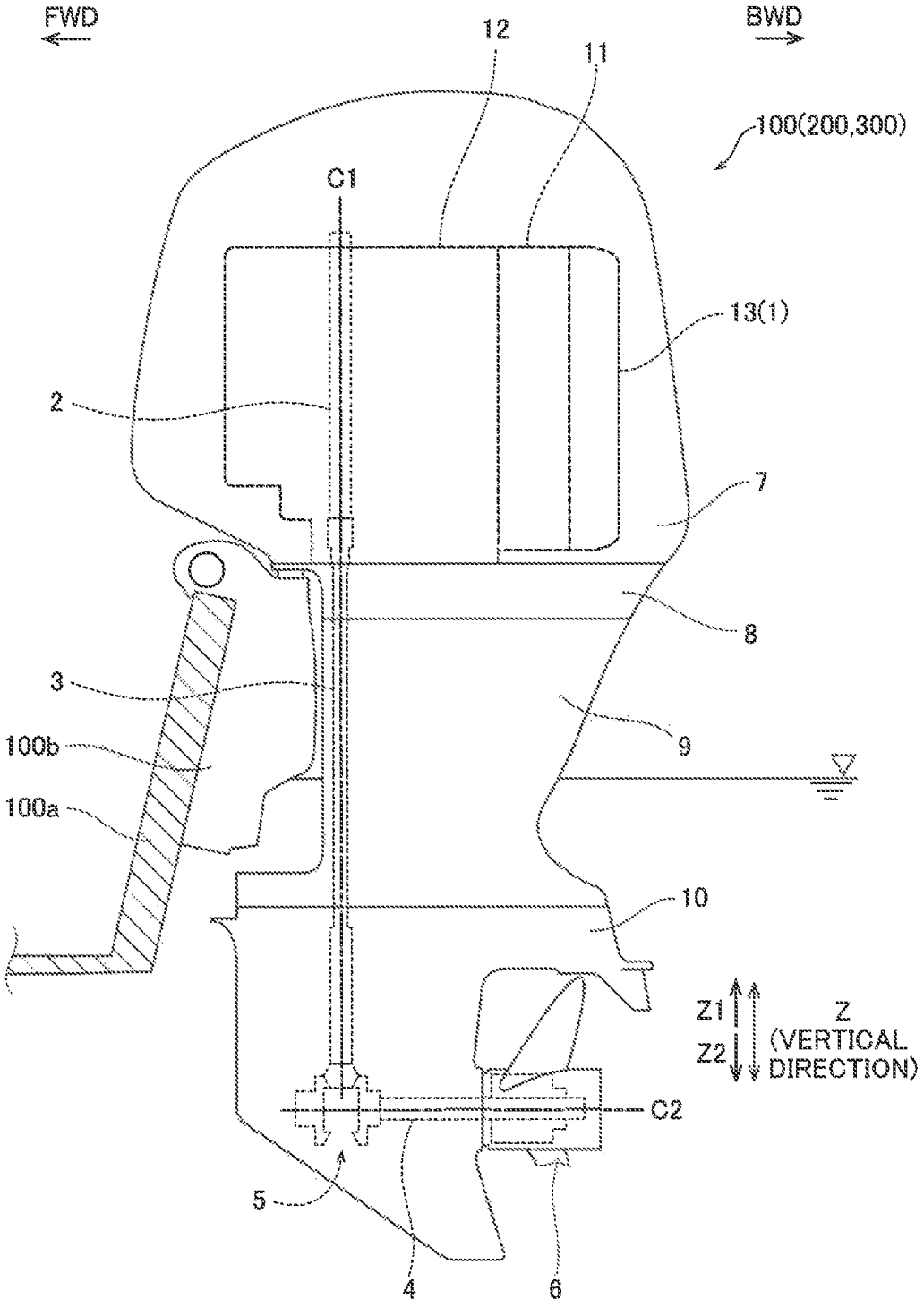
FIG. 1 is a schematic side view showing the structure of an outboard motor according to a first preferred embodiment of the present invention.

As shown in FIG. 1, the outboard motor 100 according to the first preferred embodiment is attached to a portion (rear portion) of a hull 100*a* in a BWD direction via a bracket 100*b*, for example.

In the following description, the term "forward" represents a forward traveling direction (a direction FWD in the figures) of the hull 100*a*, and the term "rearward (rear)" represents a direction BWD in the figures. The term "forward-rearward direction" represents the forward-rearward direction of the hull 100*a*, and represents a direction parallel or substantially parallel to a propeller shaft 4 of the outboard motor 100 described below, for example. A vertical direction represents the trim/tilt direction of the outboard motor 100 and a direction Z in the figures, an upward direction corresponds to an arrow Z1 direction, and a downward direction corresponds to an arrow Z2 direction. A right-left direction represents a direction perpendicular or substantially perpendicular to the vertical direction and perpendicular or substantially perpendicular to the forward-rearward direction. A horizontal direction represents a direction along a horizontal plane perpendicular or substantially perpendicular to the vertical direction, and represents a steering direction.

The outboard motor 100 includes a water-cooled engine 1, a crankshaft 2 connected to the engine 1 and that extends downward from the engine 1, a drive shaft 3 connected to the crankshaft 2, the propeller shaft 4, a shift switch 5, and a propeller 6 connected to the propeller shaft 4. The shift switch 5 is connected to the drive shaft 3 and the propeller shaft 4.

In the outboard motor 100, the crankshaft 2 and the drive shaft 3 are rotated about a rotation axis C1 due to driving of the engine 1. The rotation about the rotation axis C1 is converted into rotation about the rotation axis C2 of the propeller shaft 4 by a gearing (not shown) of the shift switch 5 such that the propeller 6 rotates. The shift switch 5 switches a direction of rotation about the rotation axis C2 of the propeller shaft 4 to switch the movement direction of the hull 100*a* to which the outboard motor 100 is attached to a forward movement direction (FWD direction) or a rearward movement direction (BWD direction).

The outboard motor 100 includes a cowling 7, an exhaust guide 8 connected to the lower end of the cowling 7 and that supports the engine 1 from below, an upper case 9 disposed below the exhaust guide 8, and a lower case 10 connected to the lower end of the upper case 9. The cowling 7 covers the engine 1. Thus, the engine 1 is housed inside the cowling 7. The upper case 9 houses the drive shaft 3. The lower case 10 houses the shift switch 5. The exhaust guide 8 is an example of a "support".

An oil reservoir 14 that stores oil is disposed between the exhaust guide 8 and the upper case 9. The oil reservoir 14 is defined by combining an upper oil pan 15 connected to the lower end of the exhaust guide 8 and a lower oil pan 16 connected to the lower end of the upper oil pan 15. The oil stored in the oil reservoir 14 is pumped due to driving of an oil pump 12*a* described below, and is supplied to each portion of the engine 1, for example.

Figure 2:
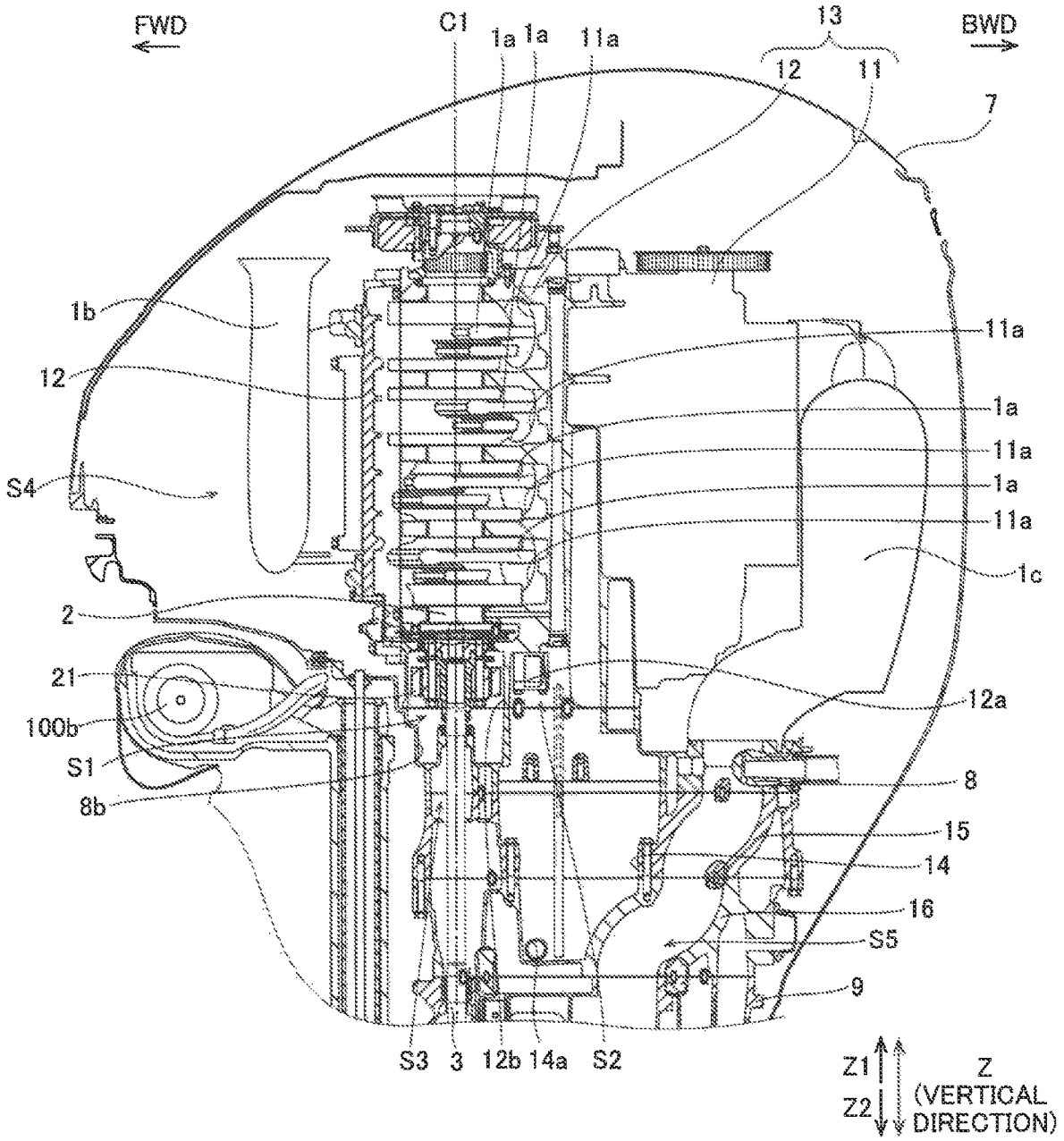
FIG. 2 is a sectional view showing the upper structure of the outboard motor according to the first preferred embodiment of the present invention.

The engine 1 is cooled by taking in seawater or fresh water (hereinafter collectively referred to as water) such as lake water or river water. The engine 1 includes an engine body 13 including a cylinder head 11 in which a plurality of cylinders 11*a* are disposed and a crankcase 12 in which the crankshaft 2 is housed. As shown in FIG. 2, in the engine 1, the linear drive force of a piston (not shown) provided in each of the plurality of cylinders 11*a* in the cylinder head 11 is transmitted as a rotational drive force to the crankshaft 2 via a connecting rod 1*a*. The engine body 13 includes an intake 1*b* through which air in the cowling 7 is suctioned and supplied to the engine 1 and an exhaust 1*c* through which exhaust gas discharged from the cylinders 11*a* flows.

Figure 4:
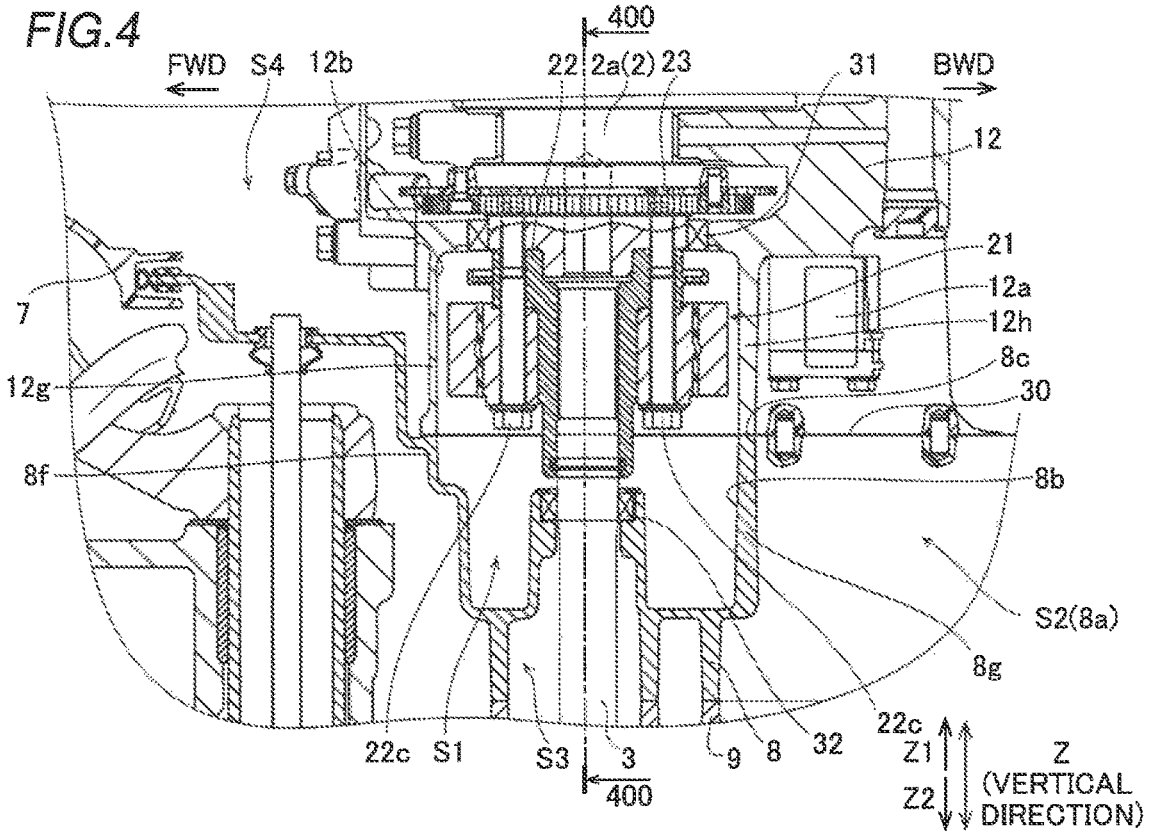
FIG. 4 is a sectional view showing the periphery of the isolated space of the outboard motor according to the first preferred embodiment of the present invention.
Figure 5:
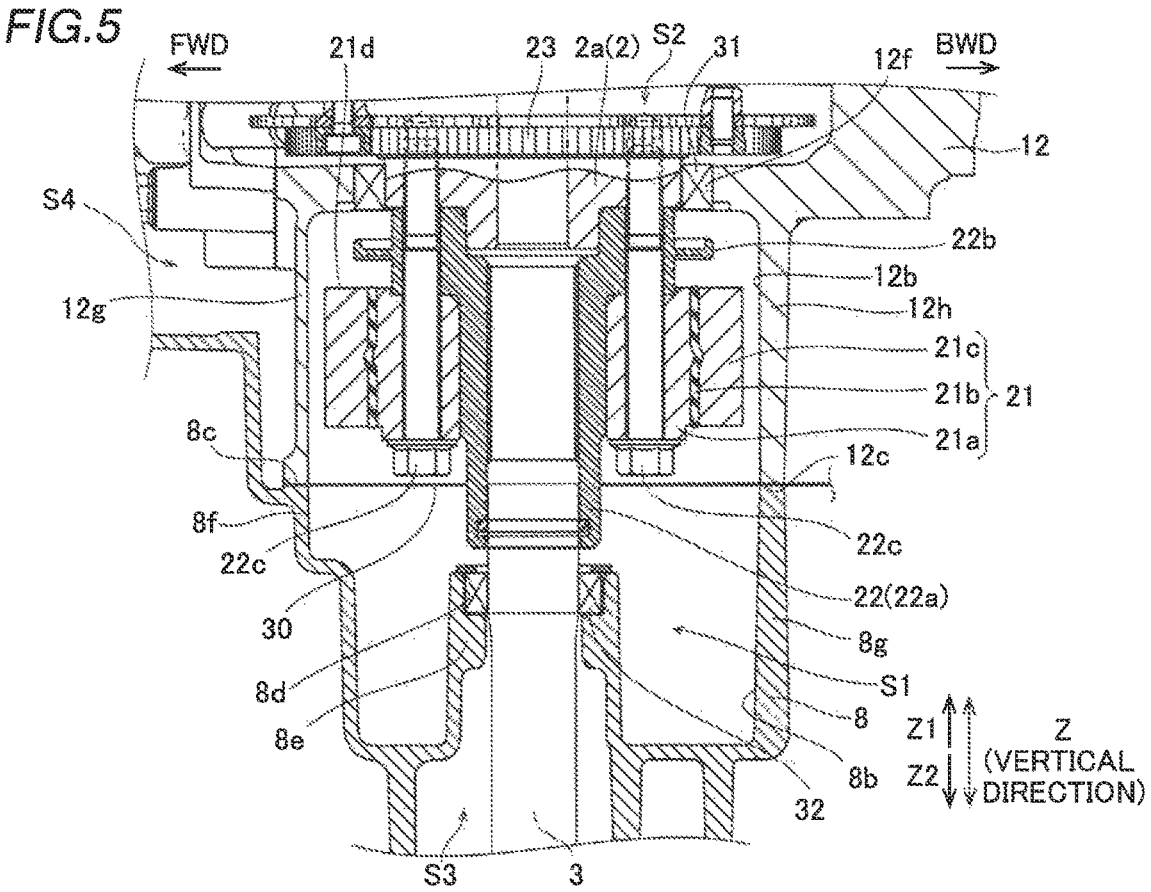
FIG. 5 is an enlarged sectional view showing the periphery of the isolated space of the outboard motor according to the first preferred embodiment of the present invention.

As shown in FIGS. 4 and 5, a damper 21 is connected to a lower portion 2*a* of the crankshaft 2. Specifically, a damper mount 22 is attached to the lower portion 2*a* of the crankshaft 2. The damper mount 22 includes a cylindrical portion 22*a* and a flange 22*b* that protrudes radially outward from an upper portion of the cylindrical portion 22*a*. An upper portion of the drive shaft 3 is inserted into the cylindrical portion 22*a*. The damper 21 is attached to the outer peripheral surface of the cylindrical portion 22*a*. Consequently, the damper 21 is connected to the lower portion 2*a* of the crankshaft 2 via the damper mount 22.

The damper 21 significantly reduces or prevents a torsional resonance caused by rotation of the crankshaft 2. Specifically, as shown in FIG. 5, the damper 21 includes a fixing portion 21*a*, a rubber portion 21*b* disposed over the entire outer peripheral surface of the fixing portion 21*a*, and a mass portion 21*c* disposed over the entire outer peripheral surface of the rubber portion 21*b*. A plurality of (eight, for example) fasteners 22*c* to be fixed to the damper mount 22 pass through the fixing portion 21*a*. The rubber portion 21*b* is made of rubber such that its characteristics tend to change due to oil. The damper 21 is an example of a "functional member".

The damper 21 significantly reduces or prevents (attenuates) the torsional resonance caused by the rotation of the crankshaft 2, using the torsional rigidity of the rubber portion 21*b* and the moment of inertia of the mass portion 21*c* generated as the crankshaft 2 rotates. The damper 21 is attached to the lower portion 2*a* of the crankshaft 2 such that the occurrence of a problem in the damper 21 due to the torsional resonance is significantly reduced or prevented as compared with the case in which the damper is attached to an upper portion of the crankshaft 2.

According to the first preferred embodiment, an isolated space S1 is provided in a portion in which the lower portion 2*a* of the crankshaft 2 is disposed. In the isolated space S1, the damper 21 connected to the crankshaft 2 is disposed. The isolated space S1 is defined by the crankcase 12 and the exhaust guide 8. Specifically, in a state in which a case-side recess 12*b* recessed upward in the lower portion of the crankcase 12 and a guide-side recess 8*b* recessed downward in an upper portion of the exhaust guide 8 face each other in the vertical direction, the lower end 12*c* of the crankcase 12 and the upper end 8*c* of the exhaust guide 8 contact each other via a gasket 30 described below to define the isolated space S1. The isolated space S1 is circular or substantially circular (see FIGS. 7 to 9) as viewed in the vertical direction. As shown in FIG. 2, the isolated space S1 is spaced apart downward from the engine 1. The guide-side recess 8*b* is an example of a "support-side recess".

As shown in FIGS. 3 to 6, the isolated space S1 is isolated from an oil space S2. The oil space S2 is a space through which oil for lubrication and cooling of the engine 1 mainly flows. The oil space S2 in the engine body 13 includes spaces in the cylinders 11*a* of the cylinder head 11 and a space of the crankcase 12 in which the crankshaft 2 is disposed. The oil space S2 includes a space in an oil chamber 8*a* (see FIG. 8) of the exhaust guide 8 and a space in the oil reservoir 14 disposed below the oil chamber 8*a*. The oil space S2 in the crankcase 12 is a space in which the oil pump 12*a* is disposed, and connects the oil space S2 of the engine body 13 to the oil space S2 in the exhaust guide 8.

The oil in the oil space S2 is supplied from the oil chamber 8*a* and the oil reservoir 14 into the engine body 13 via the oil pump 12*a* disposed at a lower portion of the crankcase 12, and is returned to the oil chamber 8*a* and the oil reservoir 14 via an oil passage 14*a*, for example. Note that the oil pump 12*a* is disposed in the vicinity of the isolated space S1 and at substantially the same height as that of the isolated space S1 in the vertical direction.

In the outboard motor 100 according to the first preferred embodiment, the oil that flows through the oil space S2 is prevented from moving into the isolated space S1. Specifically, as shown in FIG. 4, the isolated space S1 is partitioned in the vertical direction from the oil space S2 provided in the engine body 13, and is partitioned in the horizontal direction (the forward-rearward direction and the right-left direction) from the oil spaces S2 provided in the crankcase 12 and the exhaust guide 8. Consequently, the isolated space S1 is isolated from the oil space S2. The isolated space S1 is located below (directly below) the oil space S2 provided in the engine body 13, and is located substantially forward of the oil space S2 provided in the crankcase 12 and the exhaust guide 8 in the horizontal direction.

The isolated space S1 is isolated from a water space S3, as shown in FIGS. 2 to 6. The water space S3 is a space through which water that has entered the outboard motor 100 from the outside of the outboard motor 100 flows (is located). Specifically, the water space S3 includes a space provided below the isolated space S1 in the exhaust guide 8 and spaces provided in the upper oil pan 15 and the lower oil pan 16, and a space located below the water space S3 in the exhaust guide 8.

In the outboard motor 100 according to the first preferred embodiment, the water that flows through the water space S3 is prevented from moving into the isolation space S1. Specifically, as shown in FIGS. 4 and 5, the isolated space S1 is partitioned in the vertical direction from the water space S3 provided in the exhaust guide 8 such that the isolated space S1 is isolated from the water space S3. The isolated space S1 is provided directly above the water space S3.

Figure 6:
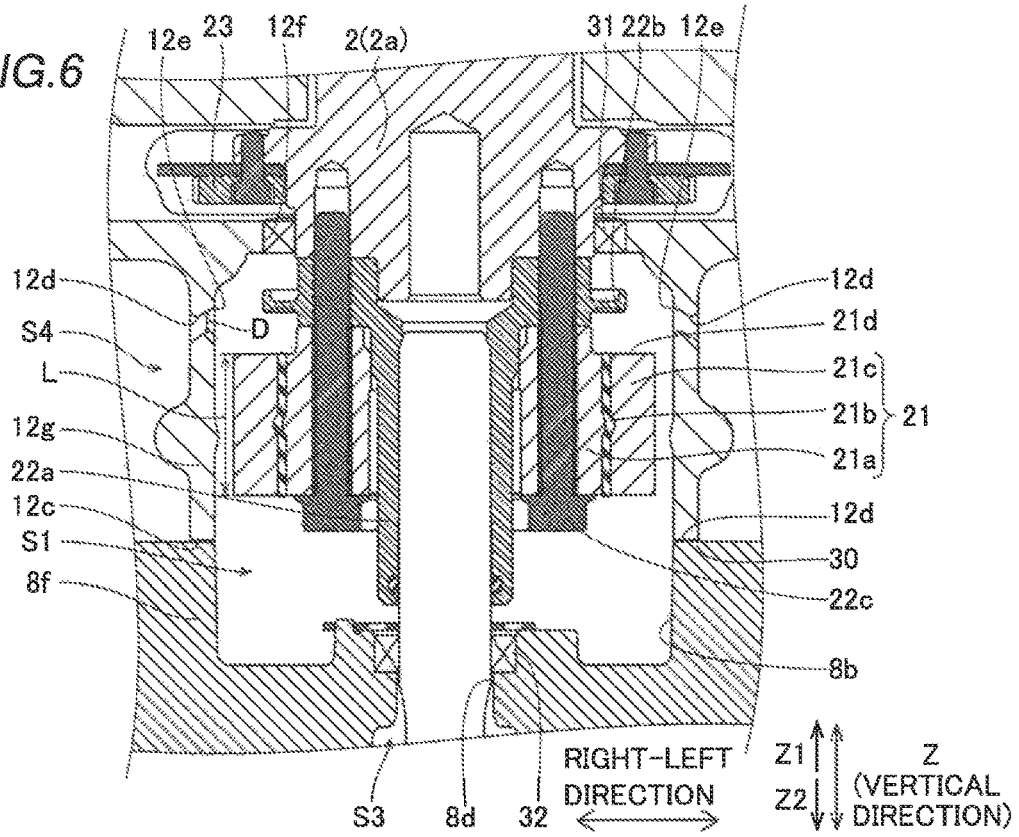
FIG. 6 is a sectional view taken along the line 400-400 in FIG. 4.

The isolated space S1 is substantially sealed such that the isolated space S1 is isolated from the oil space S2 and the water space S3. Specifically, as shown in FIGS. 4 and 6, the isolated space S1 is partitioned from a space outside the engine body 13 and inside the cowling 7 (cowling internal space S4) in addition to the oil space S2 and the water space S3. The isolated space S1 is partitioned in the horizontal direction (the forward-rearward direction and the right-left direction) from the cowling internal space S4. The cowling internal space S4 is a space in which oil and water are not normally located, and is a space in which air (atmosphere) introduced from the outside of the outboard motor 100 is substantially located. The isolated space S1 is located substantially rearward of the cowling internal space S4 in the horizontal direction. Consequently, foreign matter (floating matter in the atmosphere, etc.) in the cowling internal space S4 is prevented from moving into the isolated space S1.

Figure 7:
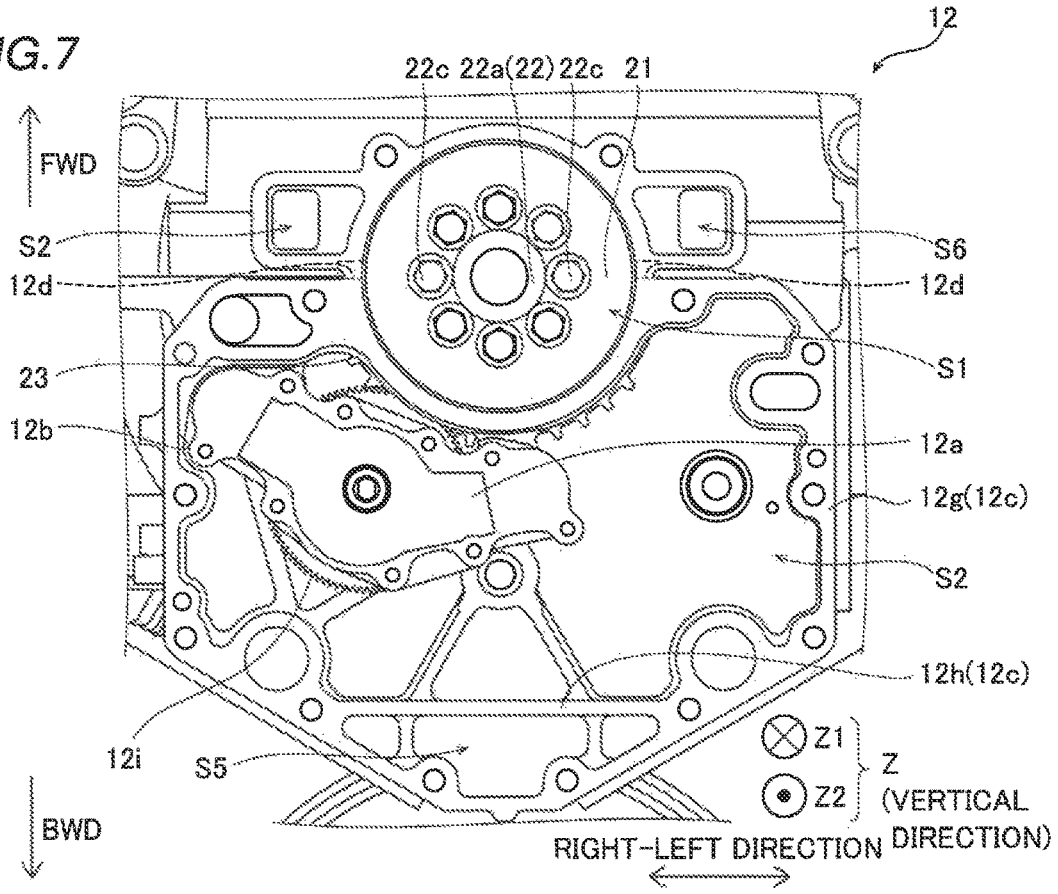
FIG. 7 is a plan view of a crankcase of the outboard motor according to the first preferred embodiment of the present invention, as viewed from below.

As shown in FIGS. 6 and 7, the crankcase 12 includes communication holes 12*d* that open into the isolated space S1 and the cowling 7 (the cowling internal space S4). The air in the isolated space S1 and the air in the cowling 7 are exchanged via the communication holes 12*d* to ventilate the isolated space S1. In the damper 21, heat is generated due to elimination of the torsional resonance, and thus the temperature of the air in the isolated space S1 is increased. The air, the temperature of which has been increased, is discharged into the cowling internal space S4 via the communication holes 12*d*.

A plurality of (two, for example) communication holes 12*d* are provided in the crankcase 12. Specifically, the two communication holes 12*d* are respectively provided at the ends of the isolated space S1 in the right-left direction. That is, the two communication holes 12*d* are provided at positions that face each other and at equiangular (180-degree) intervals as viewed in the vertical direction. The two communication holes 12*d* are provided at substantially the same position (height) in the vertical direction. Openings 12*e* of the communication holes 12*d* in the isolated space S1 are located above the upper surface 21*d* of the damper 21.

As shown in FIG. 6, the communication holes 12*d* each have a sufficiently small diameter D. For example, the diameter D of each of the communication holes 12*d* is smaller than the length L of the damper 21 in the vertical direction. Consequently, even when the communication holes 12*d* are provided, the sealed state of the isolated space S1 is maintained. The communication holes 12*d* are inclined downward from the isolated space S1 into the cowling 7 (cowling internal space S4).

As shown in FIGS. 4 to 6, the crankcase 12 includes a through-hole 12*f* that passes through the crankcase 12 in the vertical direction. The crankshaft 2 passes through the through-hole 12*f* in the vertical direction such that the lower portion 2*a* of the crankshaft 2 extends downward in the isolated space S1. The through-hole 12*f* is an example of a "first through-hole".

A seal 31 that contacts the through-hole 12*f* and the crankshaft 2 is disposed between the through-hole 12*f* and the crankshaft 2. The seal 31 is annular, the outer peripheral surface thereof contacts the inner peripheral surface of the through-hole 12*f*, and the inner peripheral surface thereof contacts the outer peripheral surface of the crankshaft 2. Consequently, the seal 31 seals the through-hole 12*f* to the crankshaft 2. Thus, the oil in the oil space S2 is prevented from passing between the through-hole 12*f* and the crankshaft 2 and moving into the isolated space S1. The seal 31 is an example of a "second seal".

The exhaust guide 8 includes a through-hole 8*d* that passes through the exhaust guide 8 in the vertical direction. The through-hole 8*d* is provided in a protrusion 8*e* of the guide-side recess 8*b*. The protrusion 8*e* protrudes upward from the inner bottom surface of the guide-side recess 8*b* at a central portion of the exhaust guide 8 as viewed in the vertical direction. The drive shaft 3 passes through the through-hole 8*d* in the vertical direction such that the upper portion of the drive shaft 3 extends in the vertical direction within the isolated space S1.

A seal 32 that contacts the through-hole 8*d* and the drive shaft 3 is disposed between the through-hole 8*d* and the drive shaft 3. The seal 32 is annular, the outer peripheral surface thereof contacts the inner peripheral surface of the through-hole 8*d*, and the inner peripheral surface thereof contacts the outer peripheral surface of the drive shaft 3. Consequently, the seal 32 seals the through-hole 8*d* to the drive shaft 3. Thus, the water in the water space S3 is prevented from passing between the through-hole 8*d* and the drive shaft 3 and moving into the isolated space S1. The through-hole 8*d* and the seal 32 are examples of a "second through-hole" and a "third seal", respectively.

The damper 21, the lower portion 2*a* of the crankshaft 2, an upper portion of the damper mount 22, and the fasteners 22*c* are disposed in the case-side recess 12*b* located in an upper portion of the isolated space S1. A lower portion of the damper mount 22 and the upper portion of the drive shaft 3 are disposed in the guide-side recess 8*b* located in a lower portion of the isolated space S1.

A gear 23 is attached to the crankshaft 2. The gear 23 is attached to the crankshaft 2 in the oil space S2 above the damper 21 and directly above the isolated space S1. Consequently, the isolated space S1 is located below the gear 23. The gear 23 is attached to the crankshaft 2 in the vicinity of the seal 31 (through-hole 12*f*) and above the seal 31. The gear 23 transmits the rotational drive force of the crankshaft 2 to the oil pump 12*a* disposed in the oil space S2 via a gear 12*i* (see FIG. 7).

As shown in FIG. 7, the crankcase 12 includes the isolated space S1, the oil space S2, and an exhaust space S5 through which exhaust gas from the engine 1 flows. Specifically, the isolated space S1, the oil space S2, and the exhaust space S5 are disposed in a region surrounded by an outer wall 12*g* provided forward of the center of the crankcase 12 in the forward-rearward direction, and are isolated from each other by the outer wall 12*g* and an inner wall 12*h*, as viewed from below.

Figure 8:
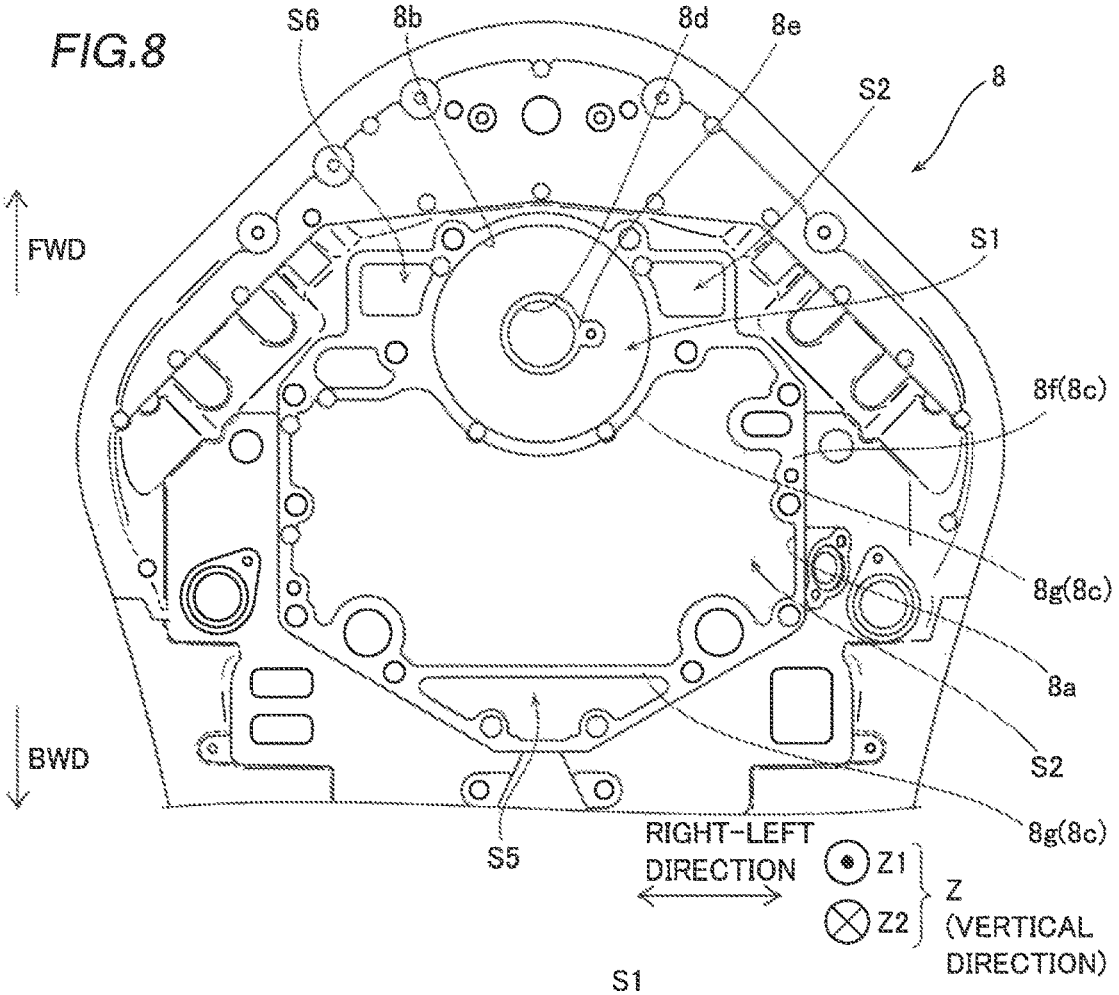
FIG. 8 is a plan view of an exhaust guide of the outboard motor according to the first preferred embodiment of the present invention, as viewed from above.

As shown in FIGS. 4 and 8, the isolated space S1, the oil space S2, the water space S3, and the exhaust space S5 are provided in the exhaust guide 8. Specifically, as described above, the water space S3 is located directly below the isolated space S1. As shown in FIG. 8, the isolated space S1, the oil space S2, and the exhaust space S5 are disposed in a region surrounded by an outer wall 8*f* provided forward of the center of the exhaust guide 8 in the forward-rearward direction, and are isolated from each other by the outer wall 8*f* and an inner wall 8*g*, as viewed from above. The isolated space S1, the oil space S2, and the exhaust space S5 of the exhaust guide 8 face the isolated space S1, the oil space S2, and the exhaust space S5 of the crankcase 12 in the vertical direction.

Figure 9:
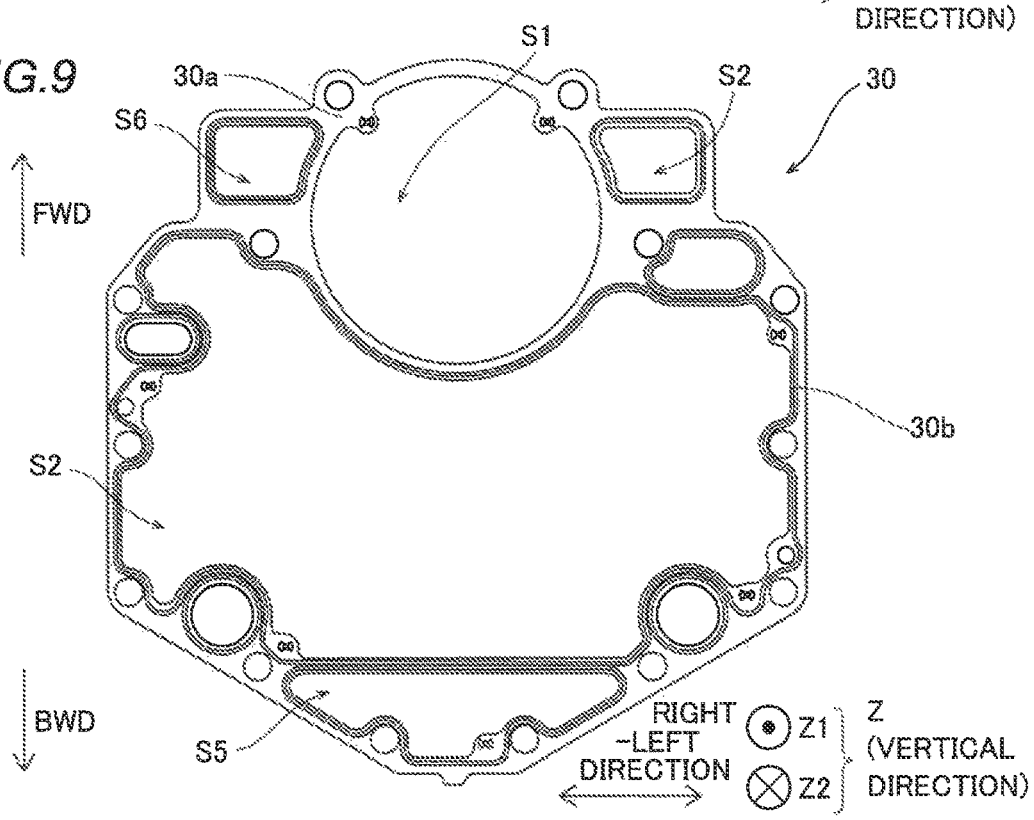
FIG. 9 is a plan view showing a gasket of the outboard motor according to the first preferred embodiment of the present invention.

The gasket 30 is disposed between the lower ends of the outer wall 12*g* and the inner wall 12*h* (the lower end 12*c* of the crankcase 12) and the upper ends of the outer wall 8*f* and the inner wall 8*g* (the upper end 8*c* of the exhaust guide 8). The gasket 30 is disposed over the entire contact portion between the lower ends of the outer wall 12*g* and the inner wall 12*h* and the upper ends of the outer wall 8*f* and the inner wall 8*g*. That is, as shown in FIGS. 7 to 9, the gasket 30 has substantially the same shape as those of the lower ends of the outer wall 12*g* and the inner wall 12*h* and has substantially the same shape as those of the upper ends of the outer wall 8*f* and the inner wall 8*g*, as viewed in the vertical direction. Consequently, the gasket 30 includes a first portion 30*a* that surrounds the isolated space S1 and a second portion 30*b* that surrounds the oil space S2. The gasket 30 is an example of a "first seal".

Therefore, the gasket 30 seals the lower end 12*c* of the crankcase 12 to the upper end 8*c* of the exhaust guide 8 such that movement of foreign matter such as oil and exhaust gas from the isolated space S1, the oil space S2, and the exhaust space S5 to other spaces is restricted.

As shown in FIGS. 7 and 8, the crankcase 12 and the exhaust guide 8 each include a water passage S6 through which cooling water is supplied to the engine 1. Similarly to the isolated space S1, the oil space S2, and the exhaust space S5, the water passage S6 is defined by the outer wall 12*g* (8*f*) and the inner wall 12*h* (8*g*) inside the outer wall 12*g* (8*f*) of the crankcase 12 (exhaust guide 8). Consequently, the water passage S6 is isolated from the isolated space S1, the oil space S2, and the exhaust space S5.

Figure 3:
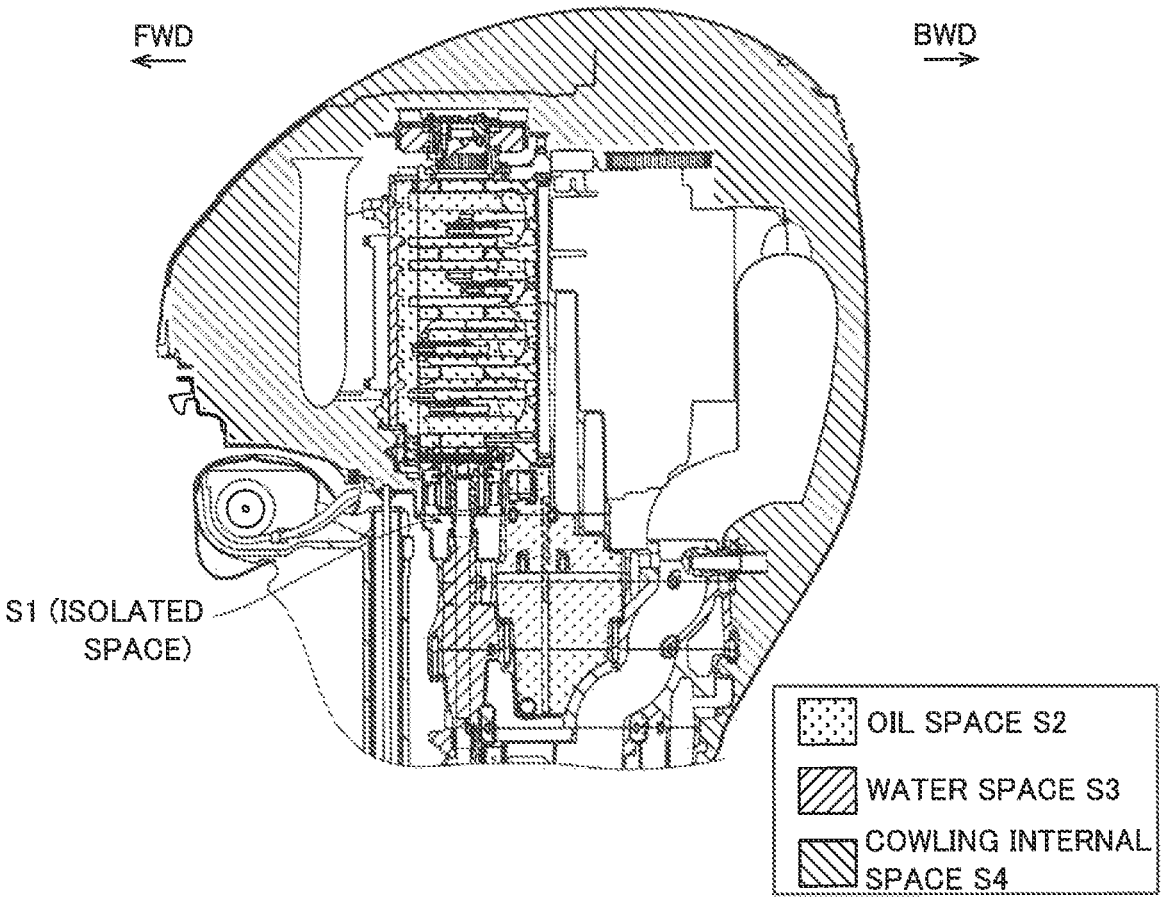
FIG. 3 is a sectional view corresponding to FIG. 2 and illustrating the positions of an oil space, an isolated space, a water space, and a cowling internal space inside the outboard motor according to the first preferred embodiment of the present invention.

As shown in FIGS. 2 and 3, in the upper oil pan 15 and the lower oil pan 16, the water space S3 is located forward of the oil reservoir 14 (oil space S2), and the exhaust space S5 is located rearward of the oil space S2. The water space S3 and the exhaust space S5 are partitioned from the oil space S2. In the exhaust space S5, the exhaust gas discharged from the engine 1 passes through the exhaust spaces S5 of the crankcase 12, the exhaust guide 8, the upper oil pan 15, and the lower oil pan 16 in this order, and is discharged from an exhaust port (not shown) provided in the upper case 9 to the outside of the outboard motor 100.

According to the first preferred embodiment of the present invention, the following advantageous effects are achieved.

According to the first preferred embodiment of the present invention, the damper 21 (functional component) is disposed in the isolated space S1 defined by the crankcase 12 and the exhaust guide 8 such that even when foreign matter (such as oil and water) is splashed from the external spaces (the oil space S2 and the water space S3, for example) in which the engine 1 etc. are disposed, the foreign matter is prevented from entering the isolated space S1, and thus the foreign matter is prevented from reaching the damper 21. That is, the isolated space S1 prevents the foreign matter (such as oil and water) from the outside from reaching the damper 21 as a functional component connected to the lower portion 2*a* of the crankshaft 2. Consequently, changes in the characteristics of the damper 21 due to the oil as the foreign matter are sufficiently significantly reduced or prevented.

According to the first preferred embodiment of the present invention, the isolated space S1 is isolated from the oil spaces S2 inside and below the crankcase 12 and from the water space S3 below the crankcase 12. Accordingly, even when the oil space S2 and the water space S3 are located around the isolated space S1 defined by the crankcase 12 and the exhaust guide 8, the isolated space S1 is isolated from the oil space S2 and the water space S3, and thus oil and water are prevented from entering the isolated space S1. Consequently, the oil and the water as foreign matter from the outside are prevented from reaching the damper 21. In addition, when a member having a low corrosion resistance against water is used as the crankshaft 2, the occurrence of a problem in the crankshaft 2 due to water is sufficiently significantly reduced or prevented.

According to the first preferred embodiment of the present invention, the isolated space S1 is substantially sealed such that the isolated space S1 is isolated from the oil space S2 and the water space S3. Accordingly, foreign matter such as oil and water from the outside is more effectively prevented from entering the isolated space S1.

According to the first preferred embodiment of the present invention, the crankcase 12 includes the communication holes 12*d* that open into the substantially sealed isolated space S1 and the cowling. Accordingly, air in the isolated space S1 is discharged into the cowling via the communication holes 12*d*. In addition, ventilation in the isolated space S1 is performed via the communication holes 12*d* while the oil and the water are prevented from moving into the isolated space S1. Thus, the air, the temperature of which has been increased in the isolated space S1, is discharged into the cowling 7 such that an increase in temperature in the isolated space S1 is significantly reduced or prevented.

According to the first preferred embodiment of the present invention, the communication holes 12*d* are inclined downward from the isolated space S1 into the cowling 7 (cowling internal space S4). Accordingly, even when water vapor slightly contained in the air in the cowling 7 is liquefied in the communication holes 12*d*, due to the downward inclination of the communication holes 12*d* into the cowling 7, liquefied water (foreign matter) is prevented from running down toward the isolated space S1. Consequently, the water as foreign matter is prevented from entering the isolated space S1 via the communication holes 12*d*.

According to the first preferred embodiment of the present invention, the lower end 12*c* of the crankcase 12 and the upper end 8*c* of the exhaust guide 8 contact each other to define the isolated space S1 and the oil space S2. Accordingly, the isolated space S1 is easily defined by the crankcase 12 and the exhaust guide 8, and the oil space S2 is easily provided inside and below the crankcase 12.

According to the first preferred embodiment of the present invention, the isolated space S1 is disposed directly above the water space S3 in the exhaust guide 8. Accordingly, as compared with the case in which the isolated space S1 is not disposed directly above the water space S3 (is disposed adjacent to the water space S3 in the horizontal direction, for example), the area of the isolated space S1 is increased in a plane perpendicular to the vertical direction.

According to the first preferred embodiment of the present invention, the case-side recess 12*b* recessed upward is provided in the lower portion of the crankcase 12, and the guide-side recess 8*b* recessed downward and that defines the isolated space S1 together with the case-side recess 12*b* is provided in the upper portion of the exhaust guide 8. Accordingly, the isolated space S1 having a certain volume is reliably provided due to the two recesses (the case-side recess 12*b* and the guide-side recess 8*b*), and thus the damper 21 is reliably disposed in the isolated space S1.

According to the first preferred embodiment of the present invention, the damper 21 is disposed in the case-side recess 12*b* of the isolated space S1. Accordingly, the damper 21 is disposed on the crankcase 12 side in the upper portion of the isolated space S1, and thus as compared with the case in which the damper 21 is disposed in the guide-side recess 8*b* of the isolated space S1, the length of the crankshaft 2 to which the damper 21 is attached is reduced in the vertical direction. Consequently, an increase in the size of the outboard motor 100 in the vertical direction is significantly reduced or prevented.

According to the first preferred embodiment of the present invention, the gasket 30 surrounds at least the isolated space S1 and seals the lower end 12*c* of the crankcase 12 to the upper end 8*c* of the exhaust guide 8. Accordingly, the gasket 30 prevents foreign matter from entering the isolated space S1 from between the lower end 12*c* of the crankcase 12 and the upper end 8*c* of the exhaust guide 8.

According to the first preferred embodiment of the present invention, the gasket 30 surrounds the oil space S2 in addition to the isolated space S1. Accordingly, leakage of the oil from the oil space S2 is significantly reduced or prevented while the gasket 30 prevents foreign matter including the oil from entering the isolated space S1 from between the lower end 12*c* of the crankcase 12 and the upper end 8*c* of the exhaust guide 8.

According to the first preferred embodiment of the present invention, the crankshaft 2 extends downward in the isolated space S1 through the through-hole 12*f* that passes through the crankcase 12 in the vertical direction, and the seal 31 seals the through-hole 12*f* of the crankcase 12 to the crankshaft 2. Accordingly, the seal 31 prevents foreign matter from entering the isolated space S1 via the through-hole 12*f*.

According to the first preferred embodiment of the present invention, the drive shaft 3 connected to the lower portion 2*a* of the crankshaft 2 in the isolated space S1 extends downward through the through-hole 8*d* that passes through the exhaust guide 8 in the vertical direction, and the seal 32 seals the through-hole 8*d* of the exhaust guide 8 to the drive shaft 3. Accordingly, the seal 32 prevents foreign matter from entering the isolated space S1 via the through-hole 8*d*.

According to the first preferred embodiment of the present invention, the isolated space S1 is disposed below the gear 23 attached to the crankshaft 2 and that transmits the rotational drive force of the crankshaft 2 to the oil pump 12*a*. Accordingly, the damper 21 connected to the lower portion 2*a* of the crankshaft 2 is reliably disposed in the isolated space S1 while the oil pump 12*a* is driven by the crankshaft 2 and the gear 23.

According to the first preferred embodiment of the present invention, a portion of the isolated space S1, the oil space S2, the water space S3, and the exhaust space S5 are provided in the exhaust guide 8. Accordingly, the isolated space S1, in which the damper 21 connected to the lower portion 2*a* of the crankshaft 2 is disposed, is defined by the exhaust guide 8 disposed between the crankcase 12 and the upper case 9 together with the crankcase 12.

Second Preferred Embodiment

The structure of an outboard motor 200 according to a second preferred embodiment of the present invention is now described with reference to FIGS. 1 and 10. According to the second preferred embodiment, an isolated space S1*a* is isolated from a water space S3 and communicates with an oil space S2*a*, unlike the first preferred embodiment.

Figure 10:
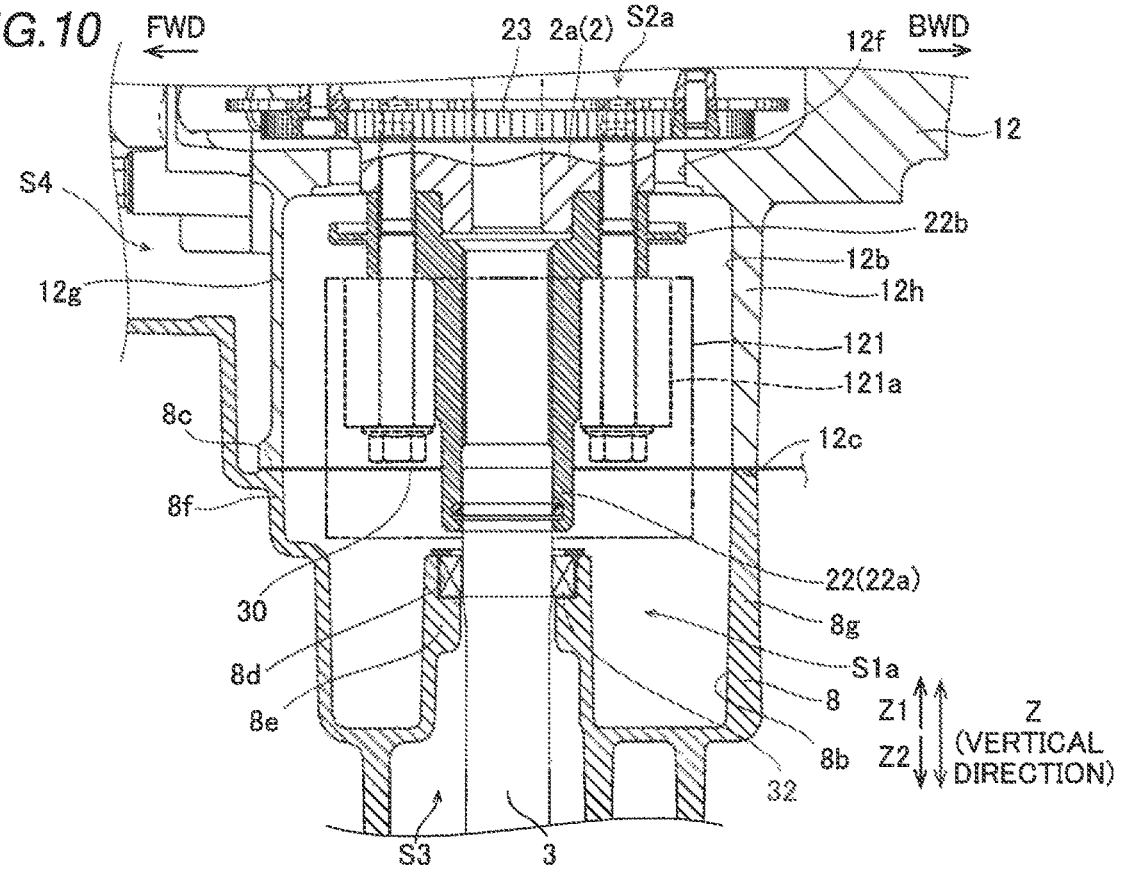
FIG. 10 is a sectional view showing the periphery of an isolated space of an outboard motor according to a second preferred embodiment of the present invention.

As shown in FIG. 10, the isolated space S1*a* is defined by a crankcase 12 and an exhaust guide 8 in a portion of the outboard motor 200 (see FIG. 1) according to the second preferred embodiment in which a lower portion 2*a* of a crankshaft 2 is disposed, similarly to the first preferred embodiment. In the isolated space S1*a*, a damper is not connected to the lower portion 2*a* of the crankshaft 2 unlike in the isolated space S1 according to the first preferred embodiment. Furthermore, in the isolated space S1*a*, a seal is not disposed between a through-hole 12*f* and the crankshaft 2 unlike in the isolated space S1 according to the first preferred embodiment. Consequently, the isolated space S1*a* communicates with the oil space S2*a*. On the other hand, the isolated space S1*a* is isolated from the water space S3 similarly to the isolated space S1 according to the first preferred embodiment. Although not shown, the crankcase 12 does not include communication holes that open into the isolated space S1*a* and a cowling 7 (cowling internal space S4).

Consequently, a functional component connected to the crankshaft 2 and that circulates oil is disposed in the isolated space S1*a* such that an oil pump 121 connected to the crankshaft 2 is disposed in the isolated space S1*a*, for example, or a functional component that uses oil (a functional component that requires lubrication and cooling by oil, for example) is disposed in the isolated space S1*a*. When the oil pump 121 is disposed in the isolated space S1*a*, a rotor 121*a* of the oil pump 121 is connected to the crankshaft 2. The remaining structures of the second preferred embodiment are similar to those of the first preferred embodiment.

According to the second preferred embodiment of the present invention, the following advantageous effects are achieved.

According to the second preferred embodiment of the present invention, the functional component that circulates oil (the oil pump 121, for example) or the functional component that uses oil is disposed in the isolated space S1*a* defined by the crankcase 12 and the exhaust guide 8. Furthermore, the isolated space S1*a* is isolated from the water space S3. Accordingly, the isolated space S1*a* prevents water as foreign matter from the outside from reaching the oil pump 121 as the functional component connected to the lower portion 2*a* of the crankshaft 2. Consequently, the occurrence of a problem in the oil pump 121 due to water is sufficiently significantly reduced or prevented. In addition, when a member having a low corrosion resistance against water is used as the crankshaft 2, the occurrence of a problem in the crankshaft 2 due to water is sufficiently significantly reduced or prevented. Furthermore, the functional component in the isolated space S1*a*, which circulates oil or which uses oil, is effectively utilized while the crankshaft 2 is protected from the water in the water space S3.

The remaining advantageous effects of the second preferred embodiment are similar to those of the first preferred embodiment.

Third Preferred Embodiment

The structure of an outboard motor 300 according to a third preferred embodiment of the present invention is now described with reference to FIGS. 1 and 11. According to the third preferred embodiment, an isolated space S1*b* is isolated from an oil space S2 and communicates with a water space S3*a*, unlike the first preferred embodiment.

Figure 11:
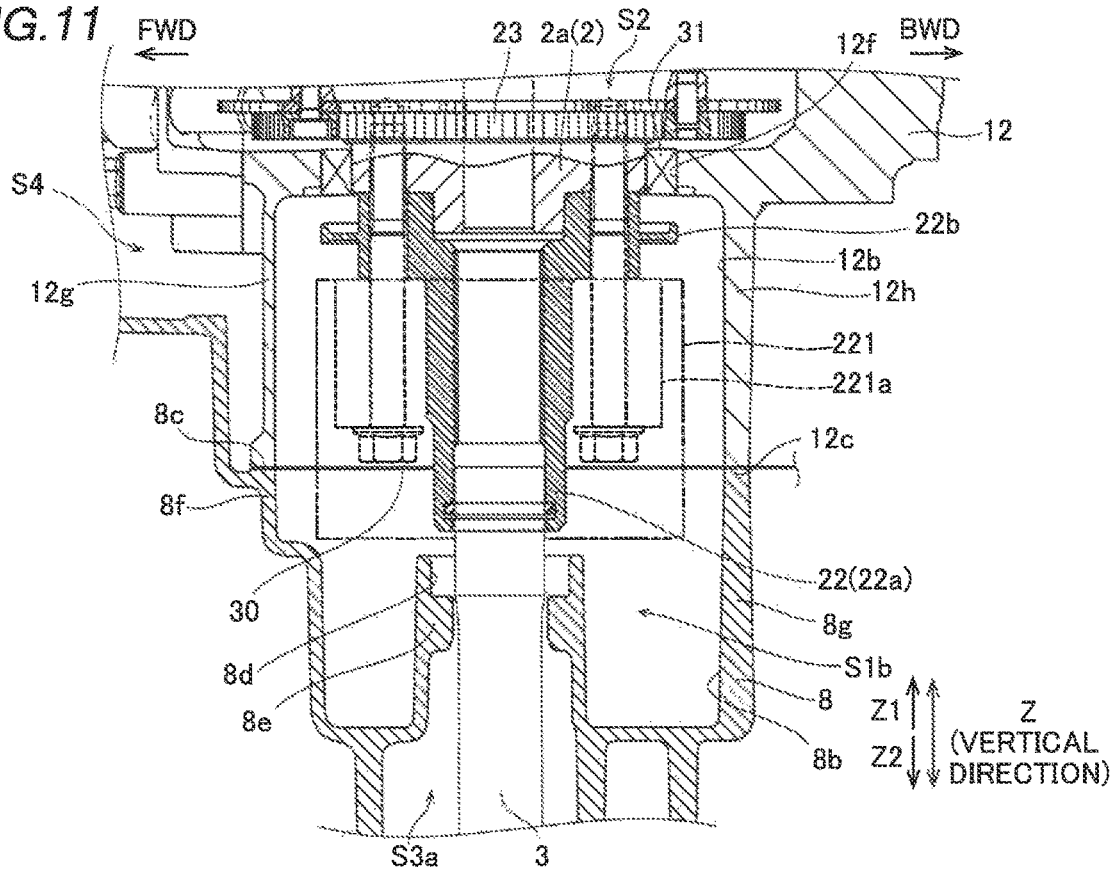
FIG. 11 is a sectional view showing the periphery of an isolated space of an outboard motor according to a third preferred embodiment of the present invention.

As shown in FIG. 11, the isolated space S1*b* is defined by a crankcase 12 and an exhaust guide 8 in a portion of the outboard motor 300 (see FIG. 1) according to the third preferred embodiment in which a lower portion 2*a* of a crankshaft 2 is disposed, similarly to the first preferred embodiment. In the isolated space S1*b*, a damper is not connected to the lower portion 2*a* of the crankshaft 2 unlike in the isolated space S1 according to the first preferred embodiment. Furthermore, in the isolated space S1*b*, a seal is not disposed between a through-hole 8*d* and a drive shaft 3 unlike in the isolated space S1 according to the first preferred embodiment. Consequently, the isolated space S1*b* communicates with the water space S3*a*. On the other hand, the isolated space S1*b* is isolated from the oil space S2 similarly to the isolated space S1 according to the first preferred embodiment. Although not shown, the crankcase 12 does not include communication holes that open into the isolated space S1*b* and a cowling 7 (cowling internal space S4).

Consequently, a functional component connected to the crankshaft 2 and that circulates water is disposed in the isolated space S1*b* such that a water pump 221 connected to the crankshaft 2 is disposed in the isolated space S1*b*, for example, or a functional component that uses water (a functional component that requires cooling by water, for example) is disposed in the isolated space S1*b*. In this case, it is preferable to use a material having a corrosion resistance against water as the crankshaft 2 or to perform corrosion-resistant treatment such as plating on the lower portion 2*a* of the crankshaft 2 such that corrosion resistance against water in the isolated space S1*b* is enhanced. When the water pump 221 is disposed in the isolated space S1*b*, a rotor 221*a* of the water pump 221 is connected to the crankshaft 2. The remaining structures of the third preferred embodiment are similar to those of the first preferred embodiment.

According to the third preferred embodiment of the present invention, the following advantageous effects are achieved.

According to the third preferred embodiment of the present invention, the functional component that circulates water or the functional component that uses water (the water pump 221, for example) is disposed in the isolated space S1*b* defined by the crankcase 12 and the exhaust guide 8. Furthermore, the isolated space S1*b* is isolated from the oil space S2. Accordingly, the isolated space S1*b* prevents oil as foreign matter from the outside from reaching the water pump 221 as the functional component connected to the lower portion 2*a* of the crankshaft 2. Consequently, unstable driving of the water pump 221 due to oil is sufficiently significantly reduced or prevented. In addition, the functional component that circulates water in the isolated space S1*b* or the functional component that uses water is effectively utilized while a problem (such as the unstable driving of the water pump 221) due to oil in the oil space S2 reaching the isolated space S1 is significantly reduced or prevented.

The remaining advantageous effects of the third preferred embodiment are similar to those of the first preferred embodiment.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the damper 21 attached to the lower portion 2*a* of the crankshaft 2 is preferably used as the "functional component" disposed in the isolated space S1 isolated from the oil space S2 and the water space S3 in the first preferred embodiment described above, the present invention is not restricted to this. The functional component disposed in the isolated space isolated from the oil space and the water space may not be a damper.

While the exhaust guide 8 (support) disposed between the crankcase 12 and the upper case 9 preferably includes the guide-side recess 8*b* (support-side recess) that defines the isolated space S1 (S1*a*, S1*b*) together with the case-side recess 12*b* of the crankcase 12 in each of the first to third preferred embodiments described above, the present invention is not restricted to this. For example, when the crankcase and the upper case directly contact each other (when the exhaust guide, the upper oil pan, and the lower oil pan are not provided), the upper case may alternatively be used as the support. In this case, the upper case preferably includes the support-side recess that defines the isolated space together with the case-side recess of the crankcase. Furthermore, the exhaust guide may alternatively directly contact the upper case without providing the upper oil pan and the lower oil pan.

While the crankcase 12 preferably includes the case-side recess 12*b* and the exhaust guide 8 (support) preferably includes the guide-side recess 8*b* (support-side recess) that defines the isolated space S1 (S1*a*, S1*b*) together with the case-side recess 12*b* of the crankcase 12 in each of the first to third preferred embodiments described above, the present invention is not restricted to this. For example, only the crankcase may alternatively include the case-side recess, and the support may not include the support-side recess. In this case, a space surrounded by the case-side recess and the upper end (upper surface) of the support defines the isolated space. Similarly, only the support may alternatively include the support-side recess, and the crankcase may not include the case-side recess. In this case, a space surrounded by the support-side recess and the lower end (lower surface) of the crankcase defines the isolated space.

While the gasket 30 (first seal) is preferably disposed over the entire contact portion between the lower ends (lower end 12*c*) of the outer wall 12*g* and the inner wall 12*h* of the crankcase 12 and the upper ends (upper end 8*c*) of the outer wall 8*f* and the inner wall 8*g* of the exhaust guide 8 (support) in each of the first to third preferred embodiments described above, the present invention is not restricted to this. For example, the first seal may alternatively be disposed only at the lower ends of the outer wall and the inner wall of the crankcase and the upper ends of the inner wall and the outer wall of the support at a position surrounding the isolated space. For example, the first seal may alternatively be disposed only at the lower ends of the outer wall and the inner wall of the crankcase and the upper ends of the outer wall and the inner wall of the support at a position surrounding the isolated space and the oil space. In addition, as long as the lower end of the crankcase and the upper end of the support closely contact each other, the first seal may not be disposed between the upper end of the support and the lower end of the crankcase.

While the crankcase 12 preferably includes the two communication holes 12*d* that open into the isolated space S1 and the cowling 7 (cowling internal space S4) in the first preferred embodiment described above, the present invention is not restricted to this. The crankcase may alternatively include one or three or more communication holes that open into the isolated space and the cowling. When the crankcase includes three or more communication holes, it is preferable to dispose the communication holes at equiangular intervals. Alternatively, the crankcase may not include the through-holes that open into the isolated space and the cowling.

While the crankcase 12 preferably includes the communication holes 12*d* in the first preferred embodiment described above, the present invention is not restricted to this. The support, and not the crankcase, may alternatively include the through-holes.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a crankshaft that extends downward from the engine;

a crankcase that houses the crankshaft;

a support that contacts a lower end of the crankcase; and a damper connected to a lower portion of the crankshaft and disposed in an isolated space defined by the crankcase and the support; wherein the crankcase includes a communication hole that ventilates the isolated space; and the communication hole is inclined downward from the isolated space into a cowling when a rotation axis of the crankshaft extends in a vertical direction.

2. The outboard motor according to claim 1, wherein an oil space through which oil flows is provided inside the crankcase;

the oil space and a water space through which water flows are provided below the crankcase; and the isolated space is isolated from the oil space and the water space.

3. The outboard motor according to claim 2, wherein the isolated space is substantially sealed such that the isolated space is isolated from the oil space and the water space.

4. The outboard motor according to claim 3, wherein the cowling covers the engine; and the communication hole opens into the substantially sealed isolated space and the cowling.

5. The outboard motor according to claim 2, further comprising:

a drive shaft connected to a lower end of the crankshaft in the isolated space and that extends downward through a second through-hole of the support; and an upper case that houses the drive shaft; wherein the support is an exhaust guide disposed between the crankcase and the upper case and includes a portion of the isolated space, the oil space, the water space, and an exhaust space through which exhaust gas from the engine flows.

6. The outboard motor according to claim 2, wherein the lower end of the crankcase and an upper end of the support contact each other to define the isolated space and the oil space.

7. The outboard motor according to claim 2, wherein the water space is provided in the support, and the isolated space is disposed directly above the water space.

8. The outboard motor according to claim 1, wherein a case-side recess recessed upward is provided in a lower portion of the crankcase; and a support-side recess recessed downward is provided in an upper portion of the support, and defines the isolated space together with the case-side recess.

9. The outboard motor according to claim 8, wherein the damper is disposed in the case-side recess of the isolated space.

10. The outboard motor according to claim 1, further comprising a first seal that surrounds at least the isolated space and seals the lower end of the crankcase to an upper end of the support.

11. The outboard motor according to claim 1, wherein the crankshaft extends downward in the isolated space through a first through-hole that passes through the crankcase in a vertical direction; and the outboard motor further includes a second seal that seals the first through-hole of the crankcase to the crankshaft.

12. The outboard motor according to claim 1, further comprising:

a drive shaft connected to the lower portion of the crankshaft in the isolated space and that extends downward through a second through-hole that passes through the support in a vertical direction; and a third seal that seals the second through-hole of the support to the drive shaft.

13. The outboard motor according to claim 1, wherein an oil space through which oil flows is provided inside the crankcase;

the outboard motor further includes:

an oil pump disposed in the oil space inside the crankcase and that circulates the oil in the oil space; and a gear attached to the crankshaft and that transmits a rotational drive force of the crankshaft to the oil pump; and the isolated space is disposed below the gear.

14. An outboard motor comprising:

an engine;

a crankshaft that extends downward from the engine;

a crankcase that houses the crankshaft;

a support that contacts a lower end of the crankcase; and a functional component connected to a lower portion of the crankshaft and disposed in an isolated space defined by the crankcase and the support; wherein the crankcase includes a communication hole that ventilates the isolated space; and the communication hole is inclined downward from the isolated space into a cowling when a rotation axis of the crankshaft extends in a vertical direction.

15. The outboard motor according to claim 14, wherein an oil space through which oil flows is provided inside the crankcase;

the oil space and a water space through which water flows are provided below the crankcase; and the isolated space is isolated from the oil space and the water space.

16. The outboard motor according to claim 15, wherein the isolated space is substantially sealed such that the isolated space is isolated from the oil space and the water space.

17. The outboard motor according to claim 16, wherein the cowling covers the engine; and the communication hole opens into the substantially sealed isolated space and the cowling.

18. The outboard motor according to claim 14, wherein a case-side recess recessed upward is provided in a lower portion of the crankcase; and a support-side recess recessed downward is provided in an upper portion of the support, and defines the isolated space together with the case-side recess.

19. An outboard motor comprising:

an engine;

a crankshaft that extends downward from the engine;

a crankcase that houses the crankshaft;

a support that contacts a lower end of the crankcase; and an isolated space defined by the crankcase and the support; wherein the crankcase includes a communication hole that ventilates the isolated space; and the communication hole is inclined downward from the isolated space into a cowling when a rotation axis of the crankshaft extends in a vertical direction.

* * * * *